United States Patent [19]

Adachi et al.

[11] Patent Number: 4,706,419

[45] Date of Patent: Nov. 17, 1987

[54] OPENABLE DOME-SHAPED ROOF STRUCTURE

[75] Inventors: Toshio Adachi, Yawata; Toru Aoyagi, Tokyo; Akihisa Kawaguchi, Iruma; Shigeki Yamanaka, Kobe, all of Japan

[73] Assignee: Ohbayashi-Gumi, Ltd., Osaka, Japan

[21] Appl. No.: 882,976

[22] PCT Filed: Dec. 28, 1985

[86] PCT No.: PCT/JP85/00732

§ 371 Date: Jun. 25, 1986

§ 102(e) Date: Jun. 25, 1986

[87] PCT Pub. No.: WO86/06123

PCT Pub. Date: Oct. 23, 1986

[30] Foreign Application Priority Data

| | | | |
|---|---|---|---|
| Apr. 9, 1985 | [JP] | Japan | 60-73583 |
| Jun. 13, 1985 | [JP] | Japan | 60-127089 |
| Nov. 19, 1985 | [JP] | Japan | 60-257638 |

[51] Int. Cl.[4] ..... E04B 1/346

[52] U.S. Cl. ..... 52/65; 52/66

[58] Field of Search ..... 52/64, 65, 66

[56] References Cited

U.S. PATENT DOCUMENTS

| | | | |
|---|---|---|---|
| 1,841,321 | 1/1932 | Arnstein | 52/65 |
| 3,195,275 | 7/1965 | Praeger | 52/83 |
| 3,975,048 | 8/1976 | Matusek | 52/65 |
| 4,075,795 | 2/1978 | Thomas | 52/80 |
| 4,204,372 | 5/1980 | Agapyan | 52/64 |
| 4,312,157 | 1/1982 | Hertel | 52/52 |
| 4,587,775 | 5/1986 | Lewis | 52/66 |

FOREIGN PATENT DOCUMENTS

| | | | |
|---|---|---|---|
| 663576 | 7/1938 | Fed. Rep. of Germany | 52/65 |
| 1529744 | 6/1968 | France | 52/65 |
| 44-15345 | 7/1969 | Japan | 52/66 |
| 44-15346 | 7/1969 | Japan | 52/66 |
| 47-32620 | 8/1972 | Japan | 52/66 |
| 60-88744 | 5/1985 | Japan | 52/66 |
| 702071 | 1/1954 | United Kingdom | 52/65 |

OTHER PUBLICATIONS

Amphitheater Umbrella, *Architectural Forum;* Nov. 1949, 4 pages, (no page numbers).

*Primary Examiner*—Henry E. Raduazo

*Attorney, Agent, or Firm*—Wenderoth, Lind & Ponack

[57] ABSTRACT

A dome-shaped roof structure for a large construction such as an athletic stadium is capable of being partly opening according to the environmental conditions such as the weather. The dome-shaped roof structure includes a dome-shaped stationary roof section having a central opening and fixedly secured at an outer periphery thereof to the external wall of the construction, and a plurality of movable roof units each having a shape to cover one of a plurality of divisions of the central opening and pivotably secured at one end thereof to a support located near the circumference of the central opening so as to be turned between a first position where the central opening is closed and a second position where the same is opened.

3 Claims, 23 Drawing Figures

OPENABLE DOME-SHAPED ROOF STRUCTURE

TECHNICAL FIELD

The present invention relates to a dome-shaped roof structure and, more particularly, to a dome-shaped roof structure capable of being partly opened according to weather conditions.

BACKGROUND ART

As is generally known, structures for athletic games, such as baseball games and athletic sports, are not provided with the roof so that athletic activities can be practiced in a natural environment. However, without roofs, athletic activities are obliged to be interrupted or to be called off if rain begins to fall during athletic activities or on a rainy day.

Recently, all-weather stadiums have been proposed and roofs, for example, a pneumatic film roof structure, for all-weather stadiums have become the object of attention.

However, the pneumatic film roof structure has the following disadvantages.

First, when an athletic stadium has a roof of a pneumatic film structure formed of films of a synthetic resin or the like, the athletic stadium is filled with pressurized air having a pressure slightly higher than the atmospheric pressure, and hence the athletic stadium needs to be sealed so that the pressurized air will not leak to the outside. This requires entrances and exits of a complicated construction for spectators and the like.

Secondly, such an athletic stadium makes internal lighting and ventilation difficult and spoils the enjoyment of practicing or watching athletic sports in a natural environment.

SUMMARY OF THE INVENTION

Accordingly, it is an object of the present invention to provide dome-shaped roof structure which is capable of being partly opened according to weather conditions for enabling daylighting and ventilation on a fine day so that athletic sports can be practiced in a natural environment or outdoors and for enabling practicing athletic sports in a comfortable condition even on a rainy day, and which is capable of being easily opened and closed.

In order to achieve the object of the invention, the present invention provides an openable dome-shaped roof structure which comprises a dome-shaped stationary roof section fixedly secured at an outer periphery thereof to an external wall constructed on the ground, an opening formed at a substantially central portion of the stationary section, and a plurality of movable roof units corresponding to and capable of covering a plurality of divisions of the central opening, and each being pivotably secured at one end thereof to a support located near the circumference of the central opening. The movable roof units are driven for turning on their pivots to close or to open the central opening.

The movable roof units are opened or closed according to environmental conditions, such as seasonal conditions or weather conditions, whereby a comfortable internal space always may be provided.

In one embodiment of the present invention, a plurality of beams are extended radially from the center of the central opening to the circumference of the central opening, and the movable roof units are supported on respective of the beams when closed. A guide member of a circular arc having its center on the junction of each beam and the circumference of the central opening may be provided between the beam and the stationary roof section to guide the respective movable roof unit for turning motion.

In another embodiment of the present invention, movable roof units are arranged along the circumference of the central opening in an alternate up-and-down arrangement so as to support each other. The movable roof units are turned simultaneously to open or close the central opening. In this case, it is preferable to provide each movable roof unit with a guide rail having a predetermined shape and a roller capable of rolling along the guide rail of one of the adjacent movable roof units.

Also disclosed herein is a method for the construction of the stationary roof section of the dome-shaped structure and which comprises the steps of: pivotably securing an outer end of each of a plurality of frame members corresponding to radial divisions of the stationary roof section to a fixed annular beam; attaching an arcuate compression beam to an inner end of each frame member; disposing expansion joints between adjacent of the compression beams; forming stationary roof units by mounting necessary parts on the frame members, with the inner ends of the frame members being placed on the ground surrounded by a side wall; and lifting up the respective inner ends of the stationary roof units until the roof units are arranged at a predetermined slope whereat the expansion joints are rigidly fixed. Thus, since the stationary roof units are assembled substantially on the ground level, they can be assembled safely and only a minimum of preparatory work is required. Furthermore, since the roof units of the stationary roof section can be assembled individually, the roof can be efficiently constructed.

The above and other objects, features and advantages of the present invention will become more apparent from the following description of the preferred embodiments thereof when taken in conjunction with the accompanying drawings.

DETAILED DESCRIPTION OF THE INVENTION

Figure 1:
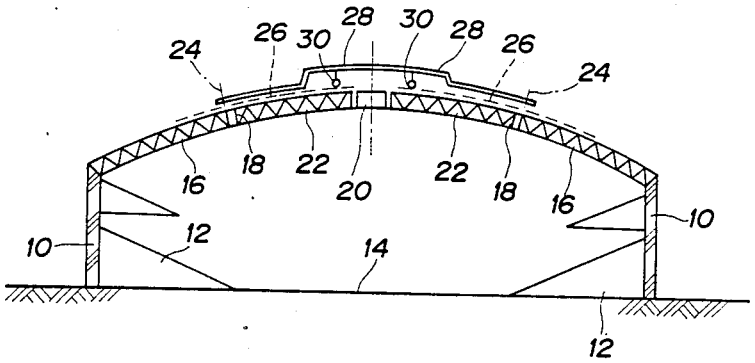
FIG. 1 is a sectional view of an openable dome-shaped roof structure according to a first embodiment of the present invention, in which the roof is in a closed position.
Figure 2:
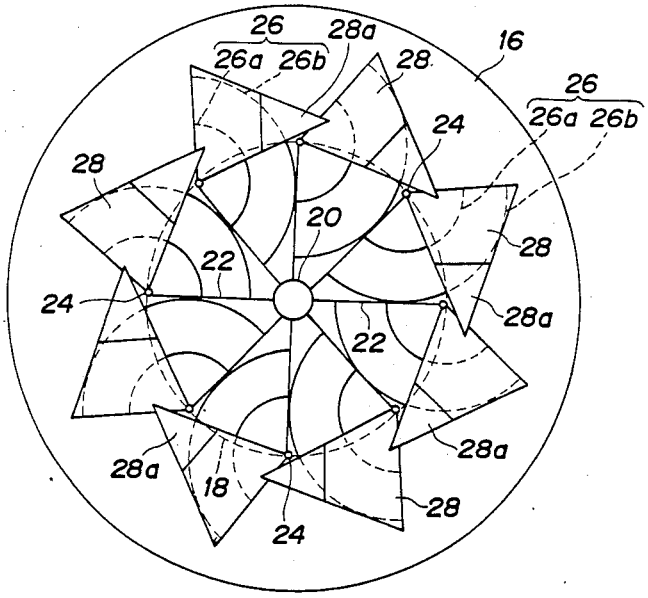
FIG. 2 is a plan view of the openable dome-shaped roof structure of FIG. 1, in which the roof is in an open position.

FIGS. 1 to 4 show an openable dome structure, according to a first embodiment of the present invention, as applied to an athletic stadium such as a baseball stadium. Stands 12 for spectators are constructed inside a generally cylindrical external wall 10 having an open upper end, and a field 14 for athletic sports is formed in the central area of the enclosure formed by the external wall 10.

A convexly curved annular stationary roof section 16 having a circular central opening 18, which corresponds to the field 14, is fixed along the outer periphery thereof to the upper end of the external wall 10.

A plurality of beams 22, eight beams 22 in this embodiment, are extended radially from the inner periphery of the stationary roof section 16 to an annular beam 20 which is located at the center of the central opening 18, thereby dividing the central opening 18 into eight sectional divisions.

The beams 22 and the stationary roof section 16 have trussed structures. Two guide members 26 each having the shape of an arc of a circle with its center on an axis 24, which passes through the junction of a respective beam 22 and the circumference of the central opening 18, are extended from each beam 22 to the stationary roof section 16. Substantially half the length of each guide member 26 is extended over the stationary roof section 16. The inner guide member 26*a* comprises only a guide rail along which a roller attached to the backside of a movable roof unit rolls, while the outer guide member 26*b* is provided with a similar guide rail for engagement with a roller, and a rack (not shown) which engages a gear wheel attached to the movable roof unit and to be driven rotatively.

Eight movable roof units 28 having the same curvature as that of the stationary roof section 16 are placed on the guide members 26. Each movable roof unit 28 has a substantially triangular shape similar to the sectorial division formed by dividing the central opening 18 by the beams 22 and is pivoted at one end thereof for turning motion about a respective axis 24. Rollers 30 which roll along the guide rails provided on the inner guide member 26*a* and the outer guide member 26*b*, respectively, and a gear wheel (not shown) which engages the rack provided on the outer guide member 26*b*, are attached to the backside of each movable roof unit 28. One corner of each movable roof unit 28 to be located near the center O of the central opening 18 when the roof unit 28 is in a closed position, is bent up to form a raised part 28*a*.

When the gear wheels attached to the movable roof units 28 are driven electrically, pneumatically or hydraulically so as to turn the movable roof units 28 about the axes 24 along the guide members 26 toward the center O of the central opening 18, the raised parts 28*a* of the movable roof units 28 are brought into abutment with each other to close the central opening 18. Thus the stationary roof section 16 and the movable roof units 28 complete the dome-shaped roof to cover the interior of the athletic stadium.

On the other hand, when the movable roof units 28 are turned radially outward from the closed position, the roof units 28 are shifted onto the stationary roof section 16 along the guide members 26 to open the central opening 18.

Figure 3:
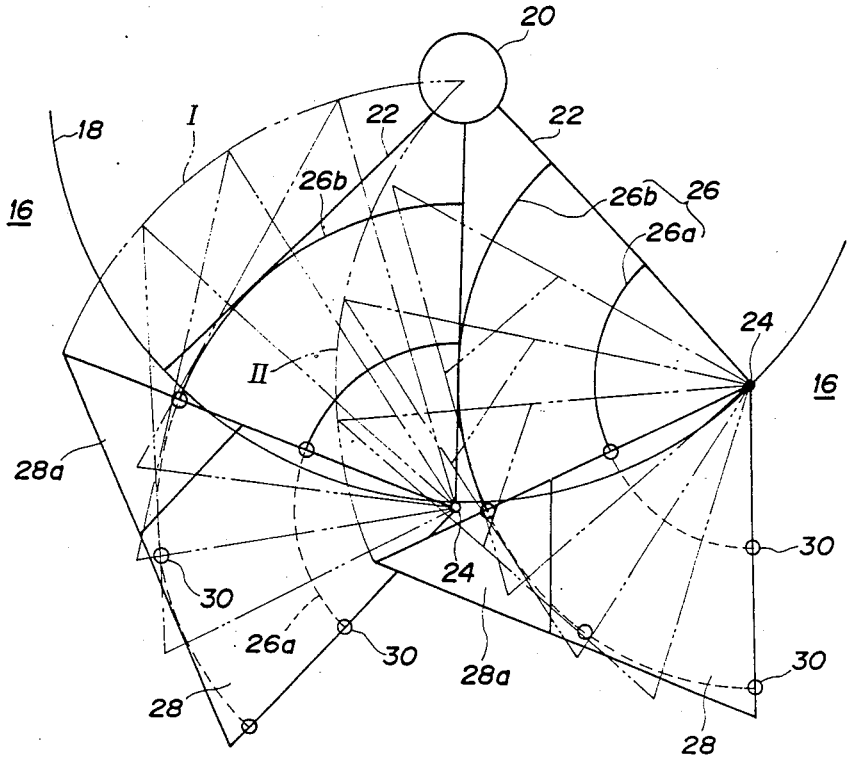
FIG. 3 is a diagrammatic illustration for assistance in explaining the turning motion of movable roof units of the roof structure.
Figure 4:
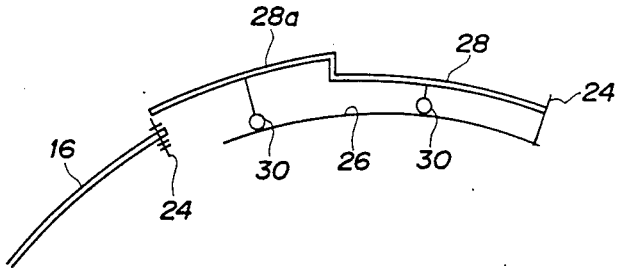
FIG. 4 is a schematic sectional view showing the movable roof unit and a guide member of the roof structure.

During the operation of the roof units 28, loci (I, II) of the turning motion of the adjacent roof units partly overlap each other as illustrated in FIG. 3. However, since the respective inner corners of the roof units 28 are bent up to form the raised parts 28*a*, the roof units 28 do not interfere with each other, and hence all the movable roof units 28 can be simultaneously turned without difficulty. Thus the movable roof units 28 can be quickly opened or closed. Means to prevent the mutual interference of the movable roof units 28 is not limited to such raised parts 28*a*. It is also possible to prevent the mutual interference of the movable roof units 28 by, for example, disposing the adjacent movable roof units 28 on different respective levels.

In the first embodiment, each movable roof unit 28 is illustrated to have a triagular shape having a straight base or the outer side. However, it is preferable that the movable roof unit 28 is formed in a sectorial shape of which outer side has an arcuate configuration having the same radius as that of the circumference of the central opening 18.

The shape of central opening 18 need not necessarily be circular but may be polygonal, and the number of the movable roof units 28 is not limited to eight but may be an optional number.

In the openable dome-shaped roof structure thus constituted, the central opening is closed by turning the movable roof units 28 toward the center of the central opening to prevent leakage of rain into the interior of the stadium or to shield the interior of the stadium from the rain or sunshine, and athletic sports can be practiced or a gathering can be held even on a rainy day or on a sunny hot day. On the other hand, in an intermediate season or on a fine day, the central opening is opened by shifting the movable roof units 28 onto the stationary roof section 16 for practicing athletic sports or the like under the sky. Furthermore, when the central opening is covered with the movable roof units in using the stadium at night, the movable roof units reflect light to enhance the effect of illumination.

An openable dome-shaped roof structure, according to a second embodiment of the present invention is shown in FIGS. 5 to 11. The significant difference from the first embodiment is that each movable roof unit in the second embodiment is supported by the adjacent units and fixed structures such as beams need not exist in the central opening.

That is, the dome-shaped roof structure shown in these figures comprises a stationary roof section 16 having a circular central opening 18, and six petaline or petal-like movable roof units 40*a* through 40*f*.

Figure 11:
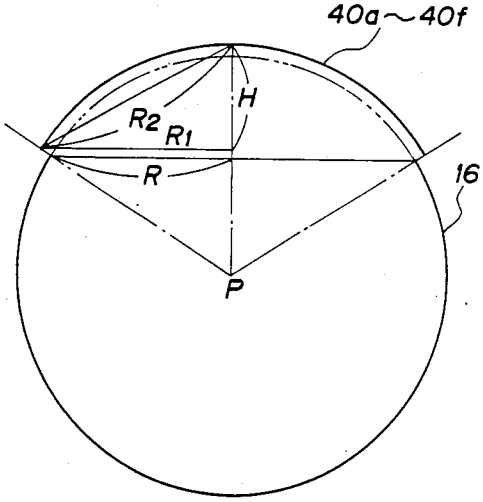
FIG. 11 is a diagrammatic illustration for assistance in explaining the curvature of the roof.
Figure 12A:
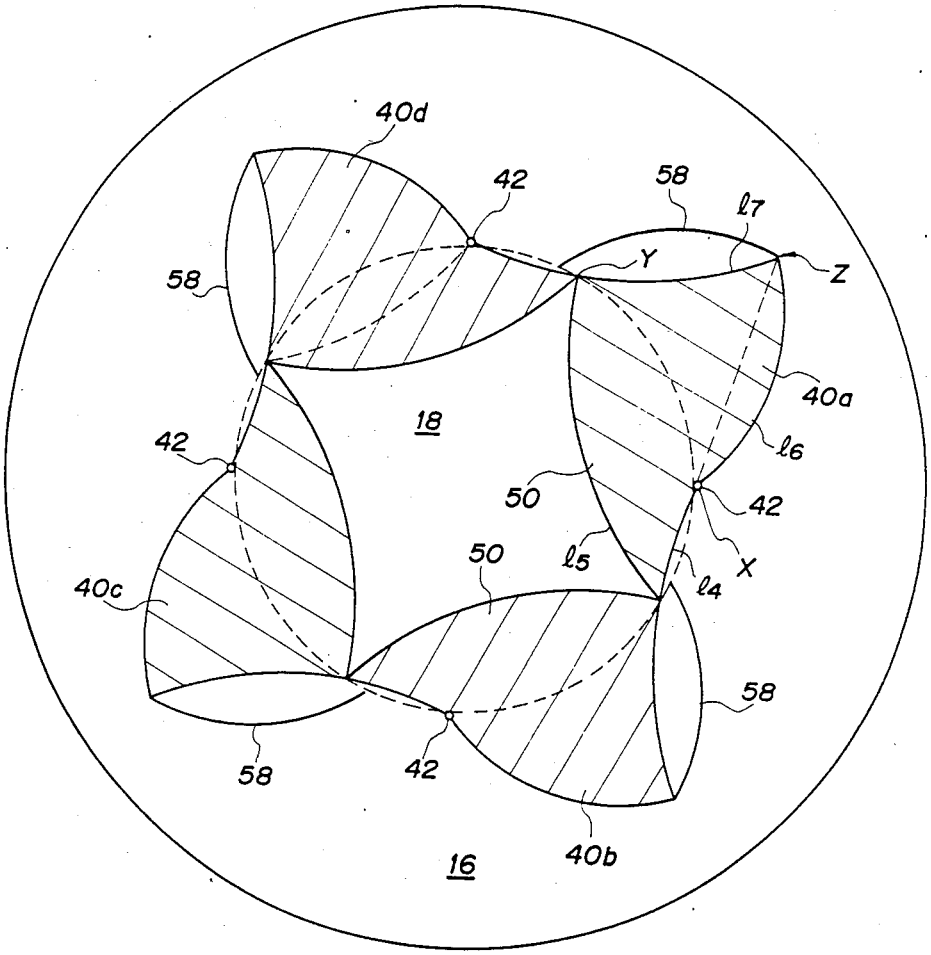
FIGS. 12 to 15 are plan views showing variations of the openable dome-shaped roof structure of FIG. 5, in which the figures denoted by numerals with a suffix "A" and the figures denoted by numerals with a suffix "B" show an open position and a closed position of the same roof structures, respectively.
Figure 12B:
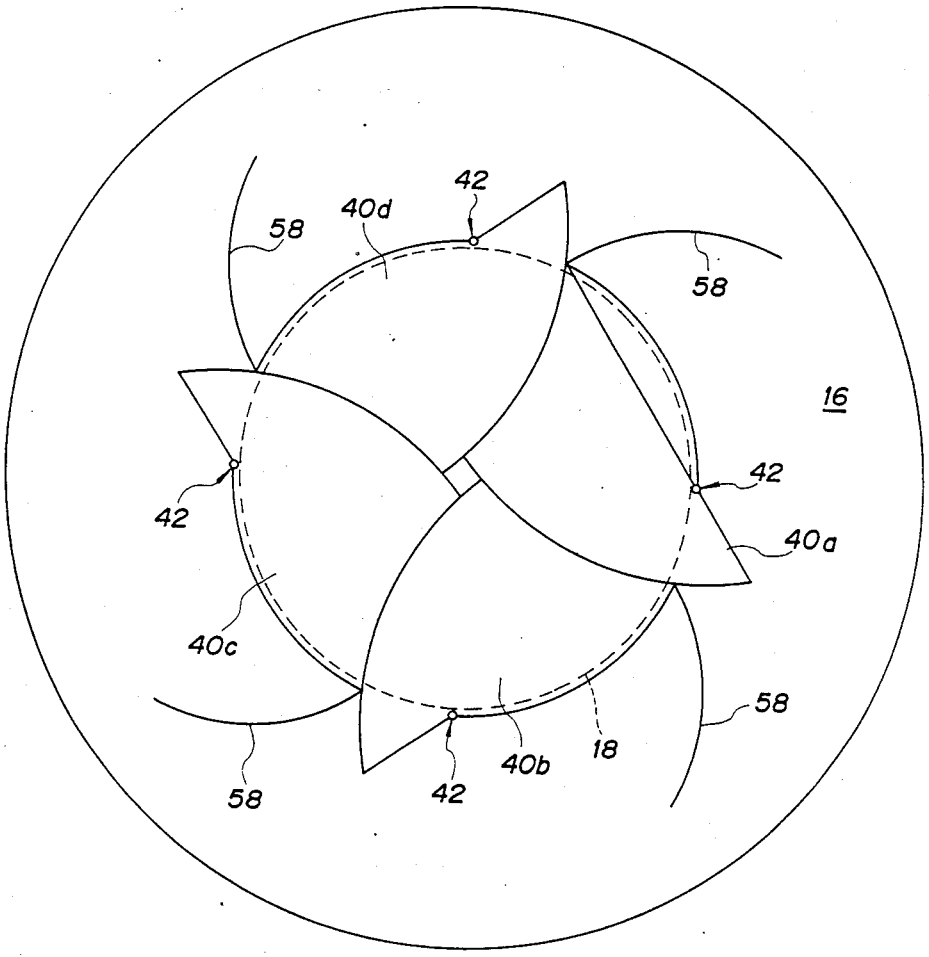
Figure 13A:
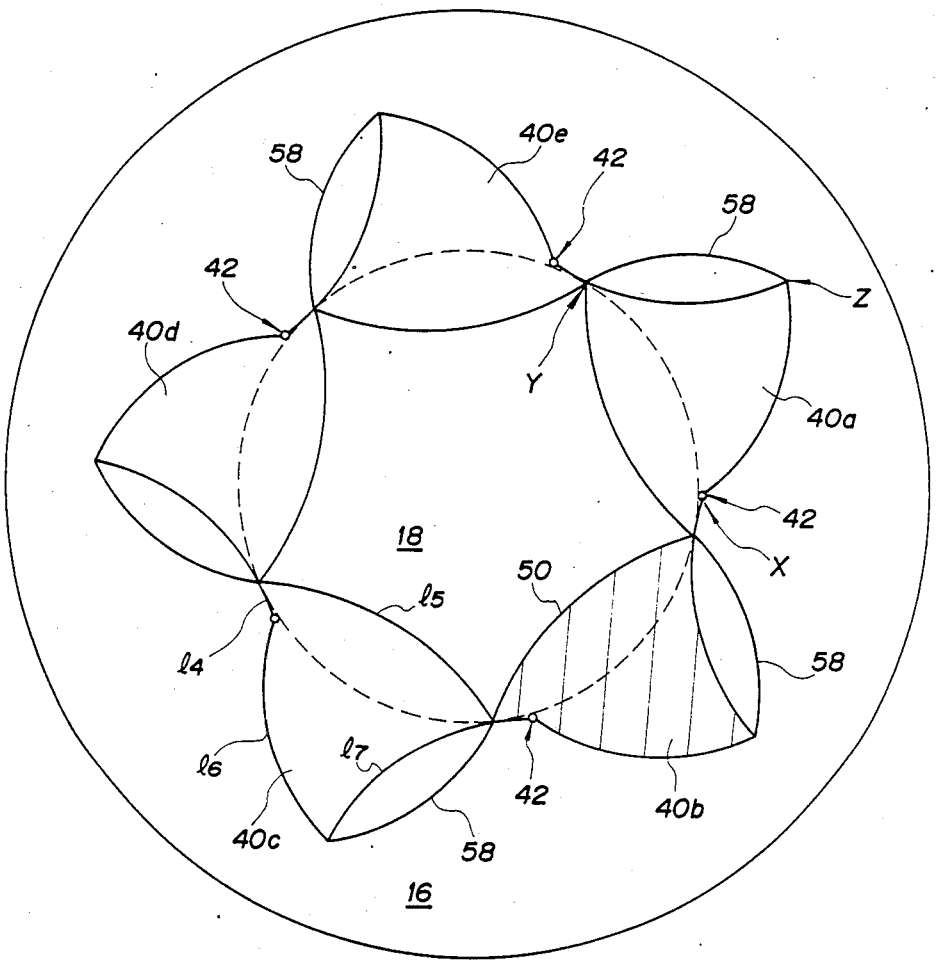
Figure 13B:
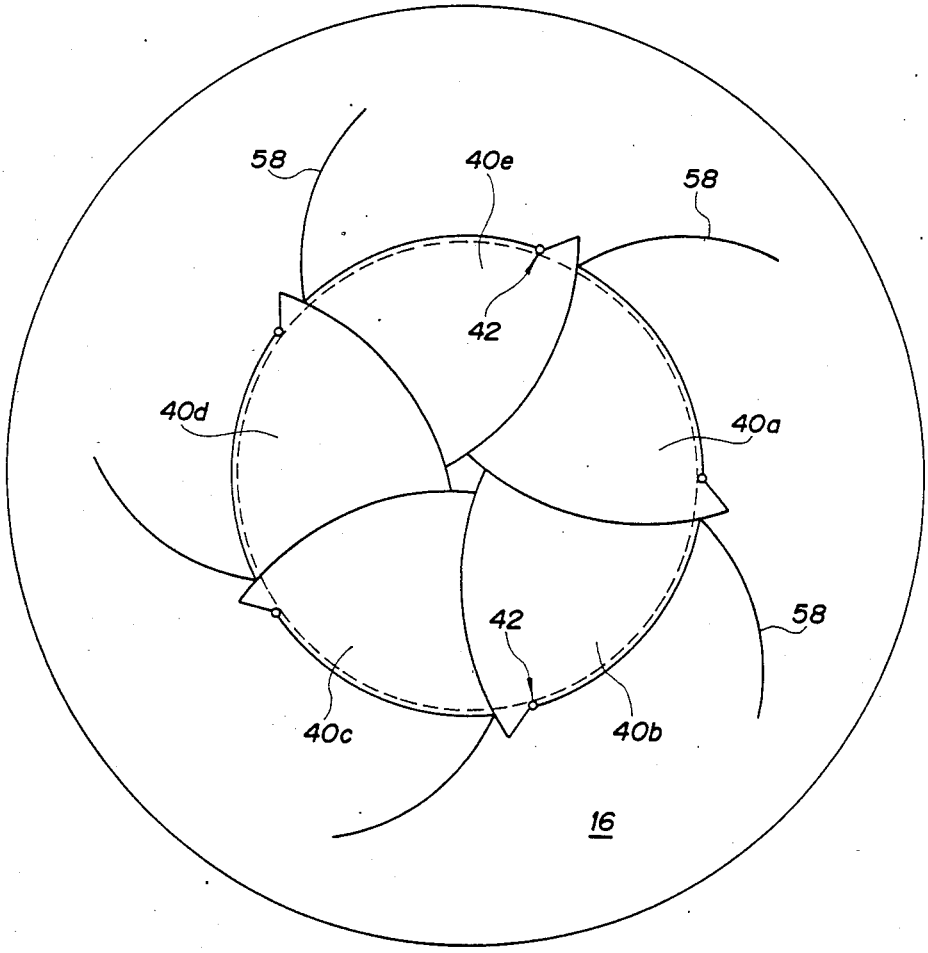
Figure 14A:
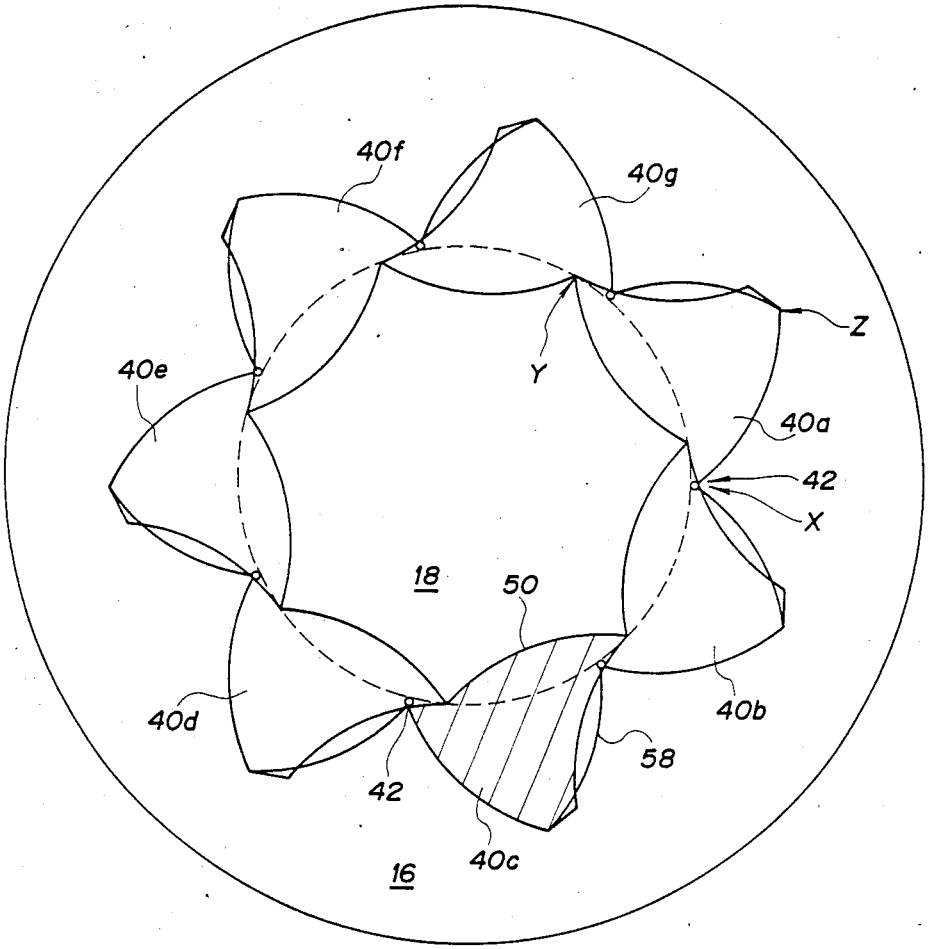
Figure 14B:
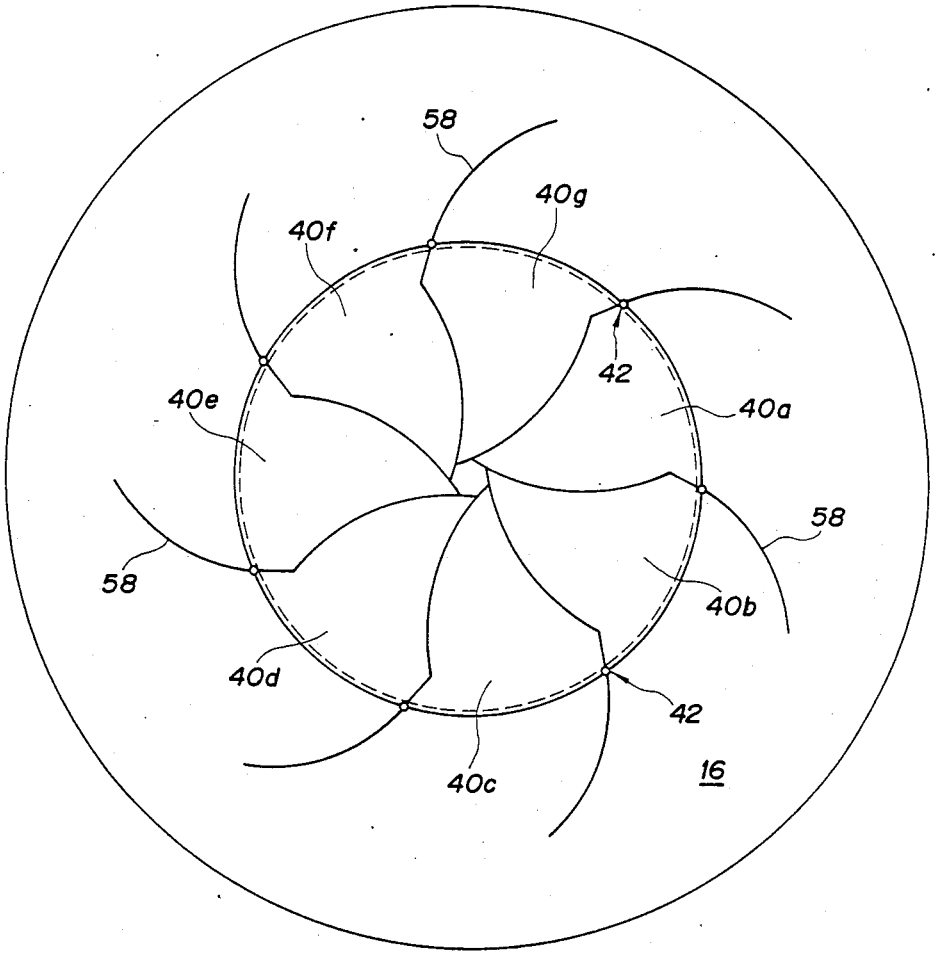
Figure 15A:
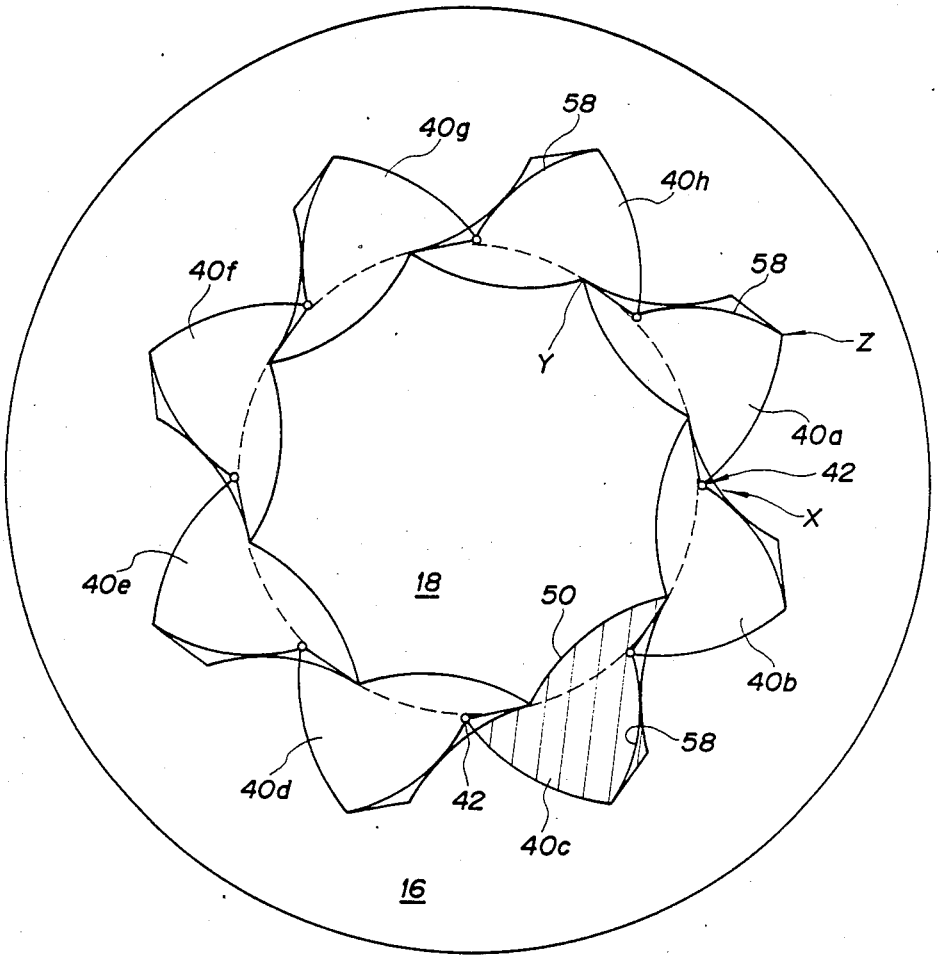
Figure 15B:
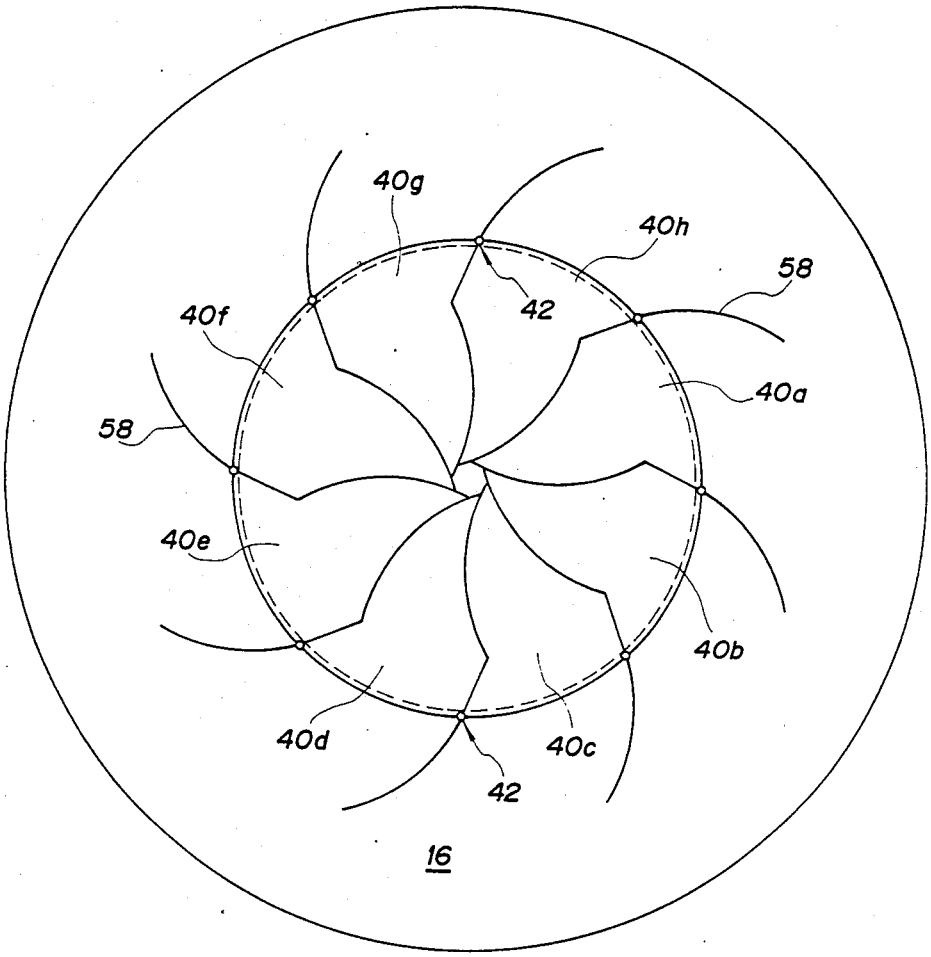

As illustrated diagrammatically in FIG. 11, the stationary roof section 16 and the movable roof units 40*a* to 40*f* are portions of spherical surfaces centered at P. The radius of curvature of the movable roof units 40*a* to 40*f* is slightly greater than that of the stationary roof section 16.

Figure 5:
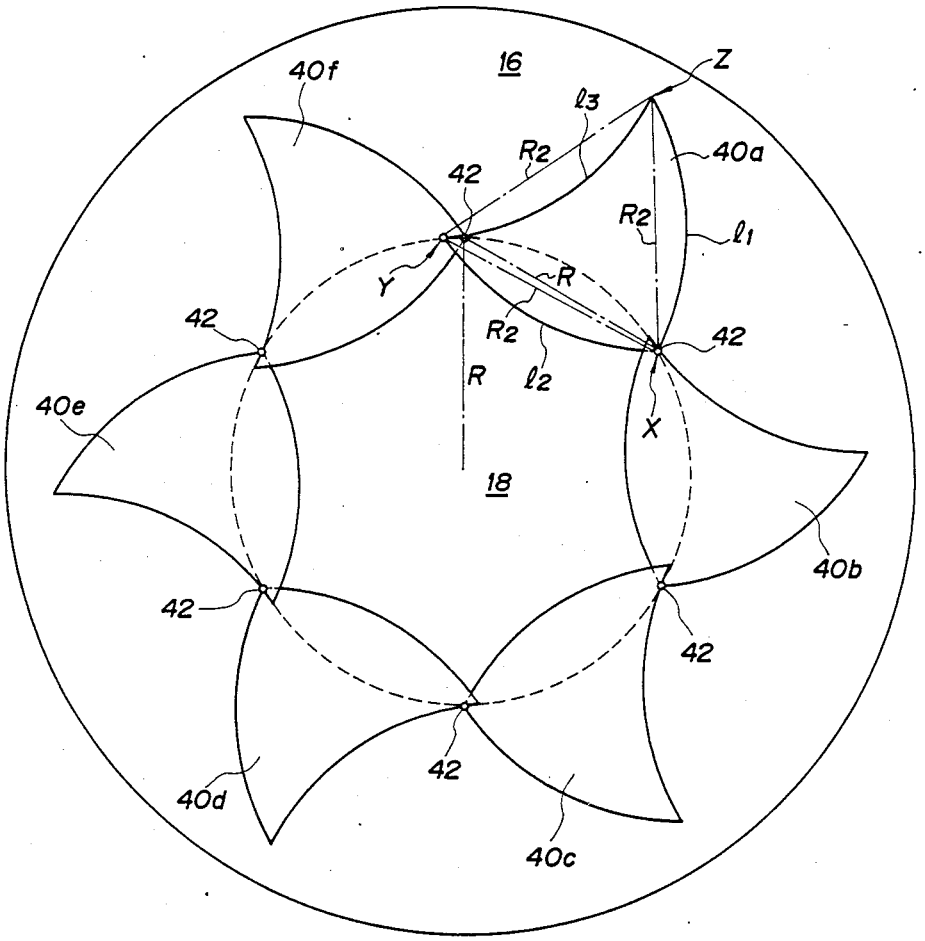
FIG. 5 is a plan view of an openable dome-shaped roof structure according to a second embodiment of the present invention, in which the roof is in an open position.
Figure 6:
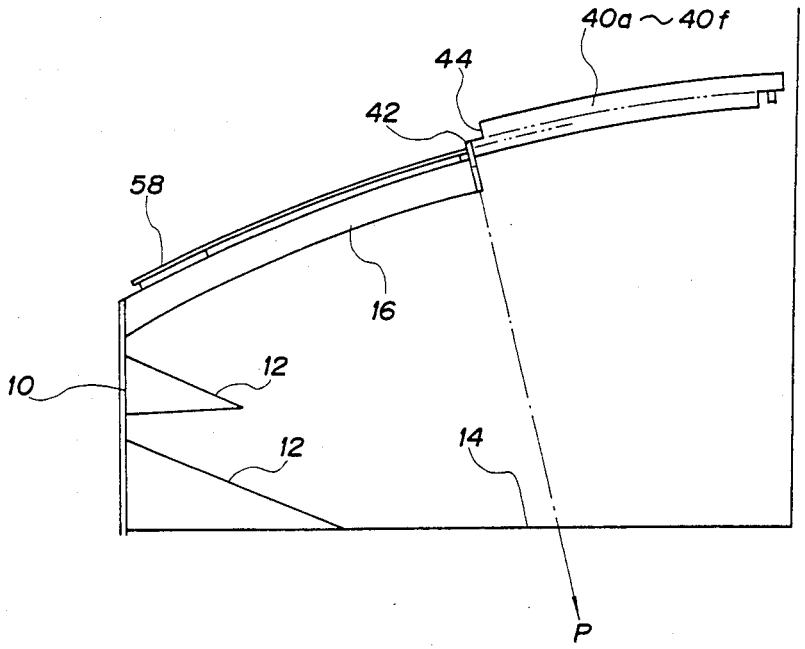
FIG. 6 is an enlarged fragmentary sectional view of the roof structure of FIG. 5.

In view of the curvature of the movable roof units 40*a* to 40*f*, the distance between the adjacent apices of each of the movable roof units 40*a* to 40*f* is slightly greater than the radius of the central opening 18. More concretely, each roof unit has a configuration, in plan view, formed by three circular arcs $l_1$, $l_2$ and $l_3$ which interconnect apices of a regular triangle having a side length $R_2 \approx \sqrt{R_1^2+H^2}$ (see FIG. 11). The arcs $l_1$ and $l_2$ are convex with respect to the respective sides of the triangle, while the arc $l_1$ is concave with respect to the corresponding side of the triangle, as illustrated in FIG. 5.

The plan shape of each of the movable roof units 40*a* to 40*f* is not limited to that illustrated and, for example, the concave circular arc $l_3$ may be replaced by a convex circular arc similar to the circular arcs $l_1$ and $1_2$.

Figure 7:
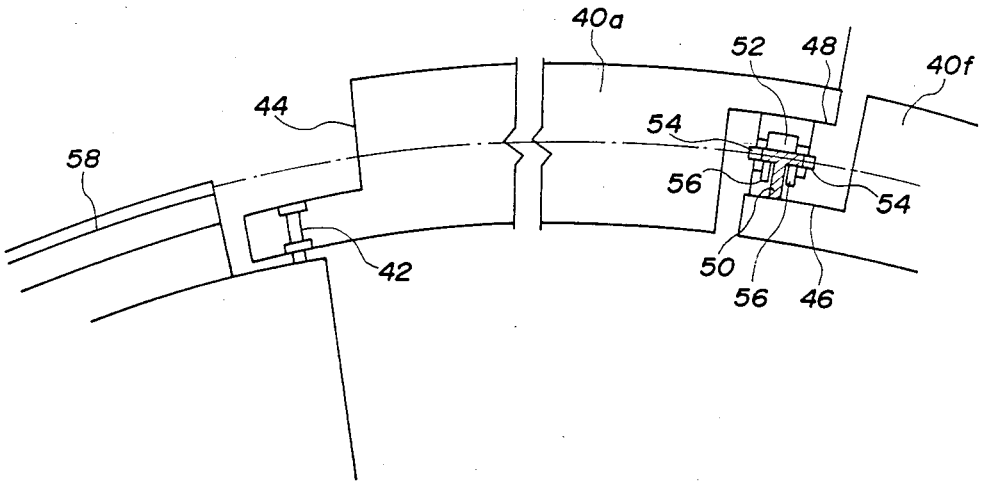
FIG. 7 is an enlarged sectional view showing the relation between the movable roof units of the roof structure of FIG. 5.

The six petaline movable roof units 40*a* to 40*f* are pivotably supported at apices X on pins 42 which are arranged at regular angular intervals (60°) along the circumference of the central opening 18. The distance between the adjacent pins 42 in a straight line is equal to the radius R of the central opening 18. These pins 42, about which the petaline movable roof units 40*a* to 40*f* are turned, are tilted so that the axes thereof pass the center P of the spherical surfaces. As illustrated in FIG. 7, recesses 44 are formed in the movable roof units 40*a* to 40*f* around the pins 42, respectively, to prevent interference between the adjacent movable roof units.

Furthermore, the adjacent movable roof units are arranged one over the other. That is, as is apparent from FIGS. 8 and 9, with particular attention to the movable roof units 40*a*, 40*b* and 40*f*, the roof unit 40*b* partly overlaps the left-hand unit 40*a* which, in turn, partly overlaps the roof unit 40*f* on the left-hand side thereof. This arrangement applies also to the rest of the movable roof units.

Driving mechanisms as illustrated in FIG. 7 are provided in the overlapping areas of the roof units 40*a* to 40*f*, respectively. The same driving mechanism is used for each roof unit, and hence the driving mechanism provided between the movable roof units 40*a* and 40*f* will be described. Steps 48 and 46 are formed in the overlapping areas of the petaline movable roof units 40*a* and 40*f*, respectively. A guide rail 50 having a T-shaped cross section is fixed on the step 46 of the unit 40*f* and extends along the curved surface of the roof unit 40*f*. The guide rail 50 is curved to be parallel to the upper surface of the petaline movable roof unit 40*f*. The longitudinal shape of the guide rail 50 is designed so that a set of rollers attached to the movable roof unit 40*a* will not derail therefrom when the movable roof units 40*a* and 40*f* are turned simultaneously and at a same speed to close the central opening 18. The guide rail 50 terminates at a position near the pin 42 of the petaline movable roof unit 40*f*.

On the other hand, rotatably secured to the step 48 of the roof unit 40*a* are a driving roller 52 that rolls along the upper surface of the guide rail 50, a pair of horizontal rollers 54 that roll along the opposite sides of the flange of the guide rail 50, and a pair of vertical rollers 56 that roll along the underside of the flange of the guide rail 50. Sets of five rollers 52, 54 and 56 are provided at each of the two apices Y and Z of the roof unit 40*a*, but not at the apex X where the roof unit 40*a* is pivoted. The distance between the set of the rollers 52, 54 and 56 provided at the apex Y and the pin 42 is approximately equal to $R_2$ and, in this embodiment, the distance between the set of the rollers 52, 54 and 56 provided at the apex Z and the pin 42 is also approximately equal to $R_2$. However, the latter distance may be any optional distance.

Figure 8:
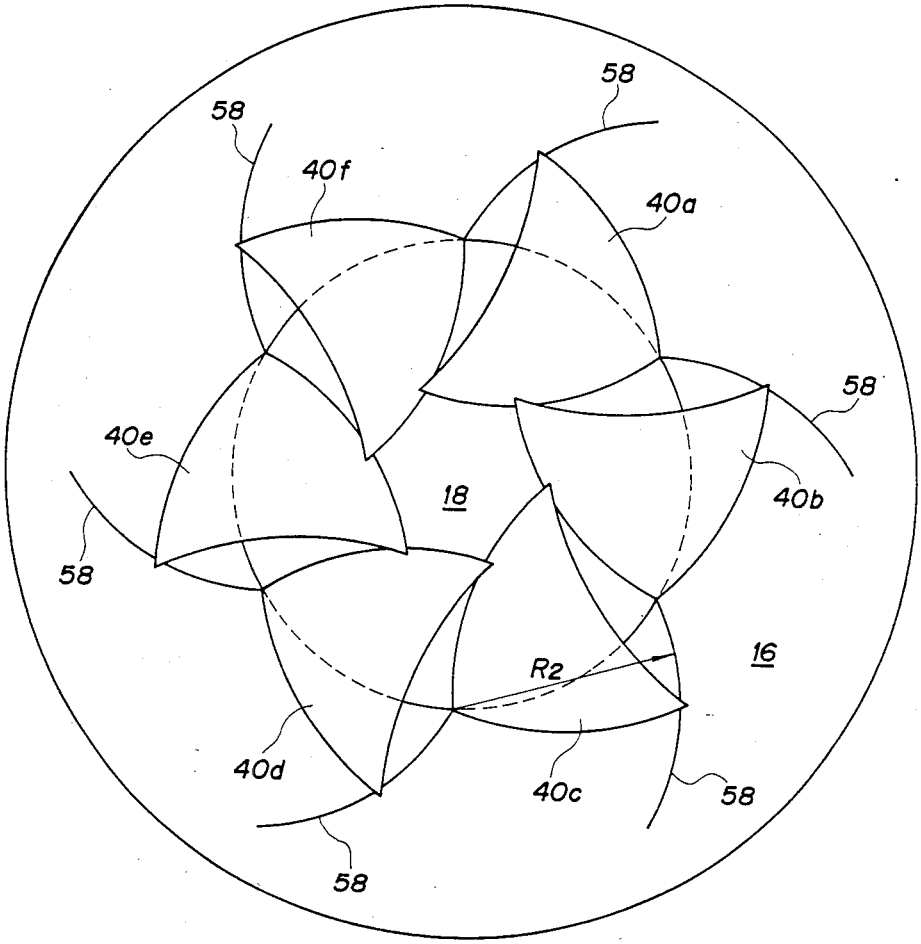
FIG. 8 is a plan view showing the movable roof units during closing motion thereof.
Figure 9:
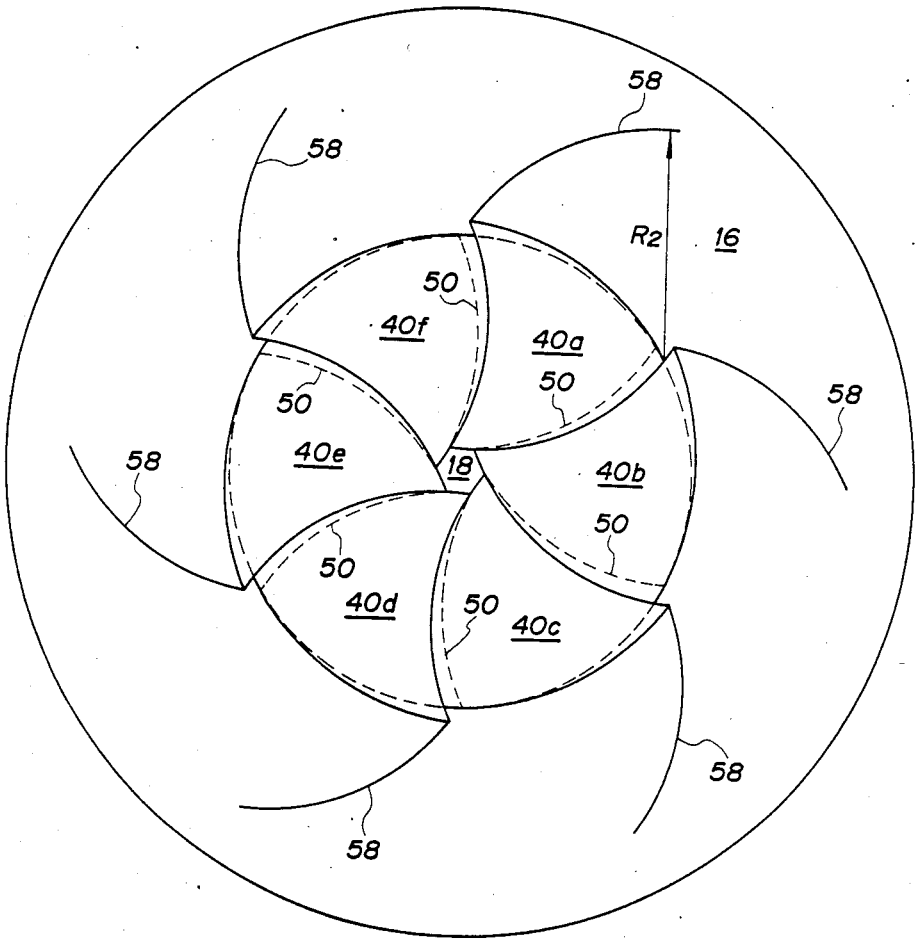
FIG. 9 is a plan view showing the movable roof units when completely closed.

As illustrated in FIGS. 7, 8 and 9, guide rails 58 similar to the guide rails 50 extend over the stationary roof section 16. The height of each guide rail 58 from the surface of the stationary roof section 16 is adjusted so that the guide rails 50 and 58 are on the same spherical surface. The longitudinal shape of each guide rail 58 is substantially a circular arc with a radius substantially equal to $R_2$ and centered at the respective pin 42, which corresponds to the locus of the set of the rollers 52, 54 and 56 provided at the apex Z.

When the petaline movable roof units 40*a* to 40*f* are turned simultaneously toward the center O of the central opening 18 by electrically, pneumatically or hydraulically driving the driving rollers 52 for rotation, the dome-shaped roof structure is completed to close the central opening 18 as shown in FIG. 9. During the turning motion, since the roof units 40*a* to 40*f* are arranged alternately one over the other, the adjacent roof units support each other. When the driving rollers 52 are rotated in the reverse direction, the roof units 40*a* to 40*f* are turned radially outward to open the central opening 18 as shown in FIG. 5.

Figure 10:
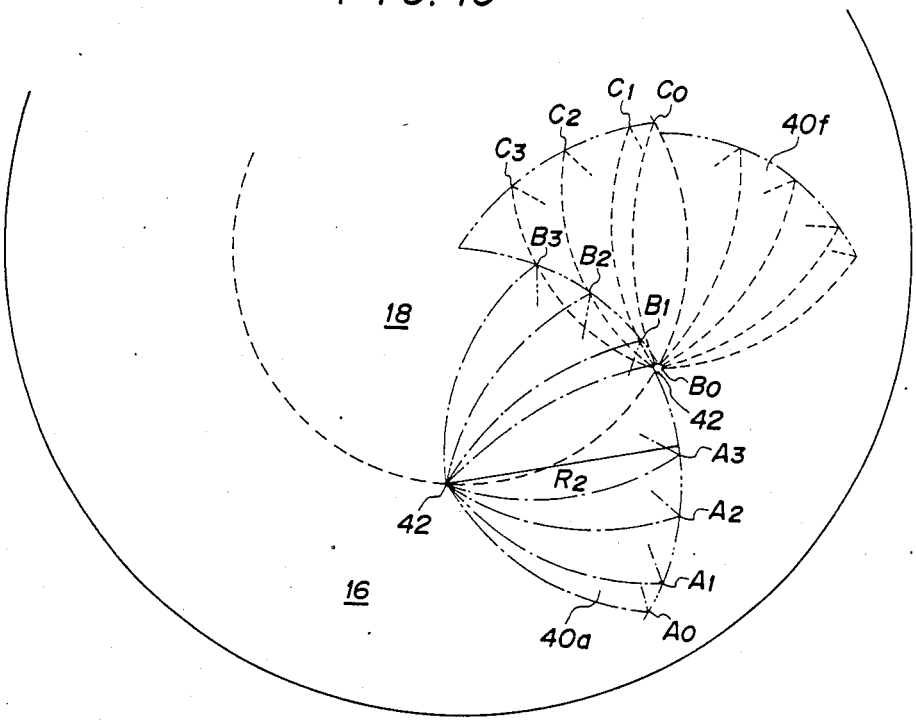
FIG. 10 is a diagrammatic illustration for assistance in explaining the turning motion of the movable roof unit of the roof structure of FIG. 5.

The turning motion of the movable roof units will be more specifically described hereinafter with reference to FIG. 10 showing the respective loci of the roof units 40*a* and 40*f*.

When the movable roof units 40*a* and 40*f* are turned simultaneously toward the center of the central opening 18 at the same speed, the two sets of the rollers 52, 54 and 56 provided at the apices Z and Y of the unit 40*a* move on a locus passing through points A0→A1→A2→A3 and on a locus passing through points B0→B1→B2→ B3, respectively. On the other hand, the guide rail 50 on the roof unit 40*f* shifts through C0→C1→C2→C3, in view of which the guide rail 50 is designed so that the rollers 52, 54 and 56 will not derail therefrom, as described above. Accordingly, the roof unit 40*a* is always supported at three points by the pin 42 and the two sets of the rollers 52, 54 and 56 during the turning motion, and therefore the roof unit 40*a* is turned stably.

In this embodiment, a small space remains uncovered in the central opening 18 when the roof units 40*a* to 40*f* are in the closed position, as shown in FIG. 9. This small space, however, may be covered with one of the roof units 40*a* to 40*f*. In this second embodiment, the central opening 18 is opened completely when the roof units 40*a* to 40*f* are turned to the open position. Accordingly, the second embodiment provides a more free and spacious feeling than the first embodiment.

Although the second embodiment is provided with six petaline roof units to close the central opening, the number of the roof units may be optional and several exemplary variations will be described hereinafter with reference to FIGS. 12 to 15.

The openable dome-shaped roof structures shown in these figures are provided with four, five, seven and eight petaline movable roof units 40, respectively. Also, the shapes of the roof units 40 in these roof structures are different from each other.

The variations shown in FIGS. 12A, 12B, 13A and 13B have smaller numbers of roof units than the second embodiment and the pins 42 are arranged at regular angular intervals of 90° and 72°, respectively. Each movable roof unit 40 is defined by a linear side $l_4$ extending from the pin 42 in a clockwise direction, an arcuate side $l_5$ extending from the end of the linear side $l_4$ within the central opening 18, an arcuate side $l_6$ with radius R extending radially outward from the pin 42, and a concaved arcuate side $l_7$ interconnecting the sides $l_5$ and $l_6$.

A set of the rollers 52, 54 and 56 is provided at each of the apices Y and Z. Guide rails 50 and 58 are provided along the arcuate side $l_5$ and on the stationary roof section 16, respectively, to guide the rollers 52, 54 and 56.

The variations shown in FIGS. 14A, 14B, 15A and 15B include greater numbers of movable roof units than the second embodiment and the pins 42 are arranged at regular angular intervals of approximately 51.4° and 45°, respectively. The shape of each roof unit 40 for these variations is substantially the same as that of the roof units shown in FIGS. 12A, 12B, 13A and 13B except that each roof unit 40 shown in FIGS. 14A to 15B has a linear side $l_4$ extending from the pin 42 in a counterclockwise direction and that the apex Z is flattened.

In the openable dome-shaped roof structure having more than or less than six petaline movable roof units, the roof units are controlled in the same manner as those of the second embodiment to open or close the central opening 18.

A construction method according to the present invention will be described hereinafter. The method is mainly directed to the construction of the stationary roof section of the above-described openable dome-shaped roof structure. The processes of a preferred embodiment of the method are shown in FIGS. 16, 17 and 18.

Figure 16:
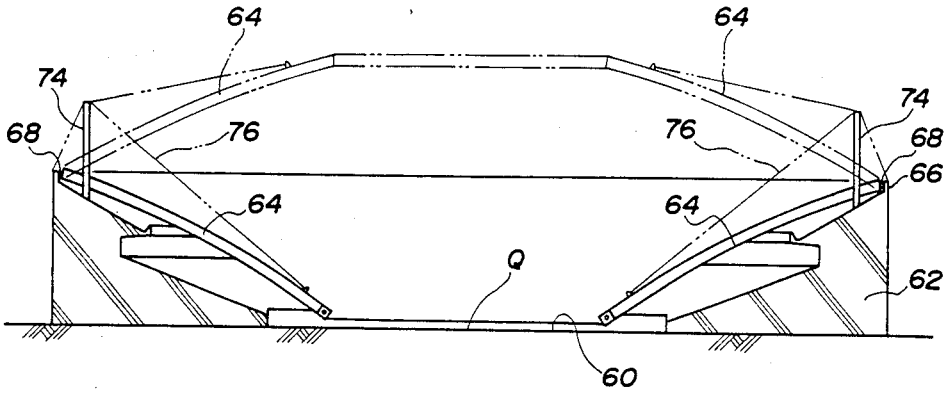
FIGS. 16, 17 and 18 are a sectional view, an enlarged fragmentary plan view and a plan view, respectively, for assistance in explaining a construction method according to an embodiment of the present invention, in which FIG. 18 the construction is completed.
Figure 17:
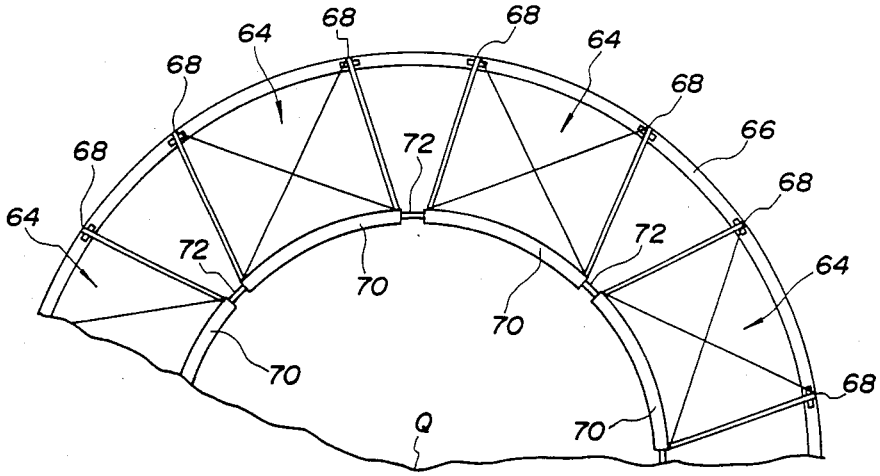
Figure 18:
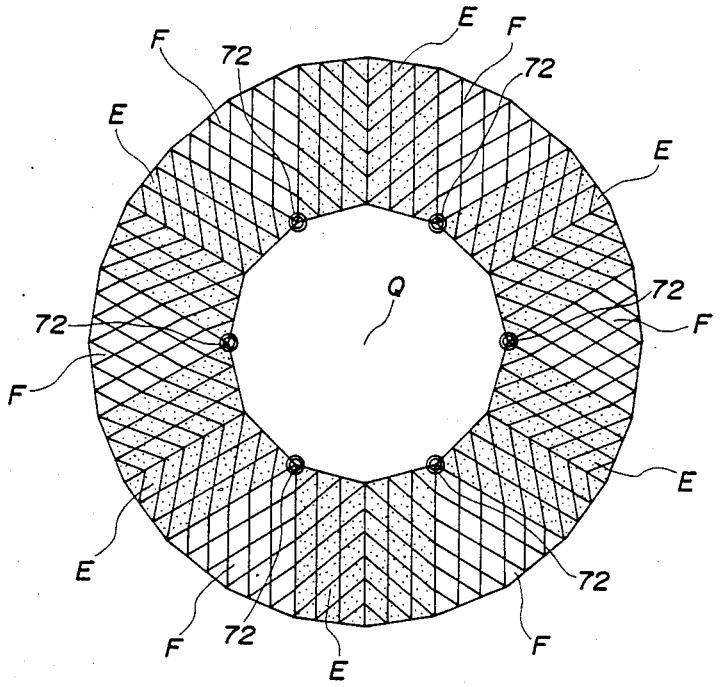

Referring to FIGS. 16 to 18, indicated at 60 is the ground of an athletic stadium such as a baseball ground, and a numeral 62 denotes a practically circular structure constructed around the ground field 60. The structure 62 has an external wall (a side wall) and stands declining in steps from the external wall toward the ground 60. The above-mentioned stationary roof section 16 is built on the external wall.

The stationary roof section comprises a plurality of frame members 64 arranged around the center Q of the structure 62. An outer or base end of each frame member 64 is secured pivotably with a pin 68 on a fixed annular beam 66 fixedly disposed along the upper end of the external wall of the structure 62. An arcuate compression beam 70 is attached to each frame member 64 to define the inner side, namely, the side facing the central opening. The adjacent compression beams 70 are joined together by respective hydraulic or mechanical expansion joints 72.

A temporary post 74 is set up for every frame member 64 at a position near the outer end thereof. A tension member 76 having one end connected to the inner side of the frame 64 is extended over the top of the temporary post 74.

Each frame 64 is assembled with the outer side being supported on the annular beam 66 by the pin 68 and the inner side being placed on the ground 60. After the frame 64 has been assembled, the components of a roofing structure, such as struts, principal rafters, purlins and common rafters, and roofing plates or films are assembled on the frame 64 to complete a roof unit for the stationary roof section 16.

After all the stationary roof units have been completed, the tension members 76 are wound to turn the frames (stationary roof units) 64 about the corresponding pins 68 so that the respective inner sides of the units 64 are lifted up. As the units 64 are turned upward, the clearances between the adjacent compression beams 70 are decreased, which is absorbed by the contraction of the expansion joints 72. The clearances decrease until the units 64 are turned to a horizontal position, and then increase again as the units 64 are turned further upward. After the units 64 have been disposed at a predetermined pitch, the expansion joints 72 are fastened rigidly to complete a stationary roof section having a central opening.

In FIG. 18, areas E shaded with dots correspond to the roofing extended over the roof units 64. Triangular areas F defined between the adjacent areas E may be roofed by extending the roofing over the units 64 or may be roofed separately after fixing the units 64 in place. The temporary posts 74 may be removed after the stationary roof section has been completed or may be reserved for use as supports or as maintenance facilities.

Figure 19:
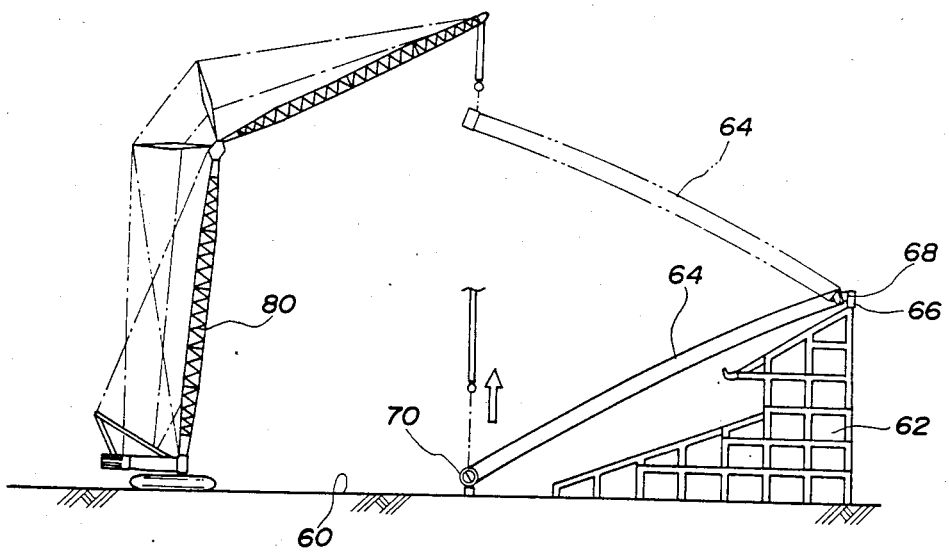
FIG. 19 an illustration for assistance in explaining a construction method according to another embodiment of the present invention.

Another method according to the present invention is shown in FIG. 19. In this embodiment, the stationary roof units 64 are lifted up by a crane 80 installed on the ground 60. The use of a lifting machine in combination with the crane 80 will enable the units 64 to be lifted more securely.

According to the embodiments described hereinbefore, the stationary roof units are assembled with the annular beam 66 being fixed on the external wall, however, the annular beam 66 need not necessarily be secured to the external wall in advance but it is also possible to lift up the annular beam 66 onto the external wall and to fix the same at a predetermined position after assembling the stationary roof section entirely on the ground.

As is apparent from the foregoing description, according to the present invention, the processes of constructing the frame members and finishing the roof units are carried out practically on the ground level with the frames being supported on the ground. Hence large-scale timbering operations including temporary standards and temporary operations including the construction of scaffoldings are unnecessary, and activities for the of safety hazards can be reduced greatly. Furthermore, the reduction of construction work on an elevated level effectively reduces labor. Since the method according to the present invention greatly reduces preparatory operations of including timbering, the work for constructing the roof structure can be started at an early time in the construction of the overall dome structure. Still further, since the plural frame members and roof units can be simultaneously fabricated, the time necesssary for such construction can be curtailed. Moreover, assembling the stationary roof units practically on the ground level facilitates inspection and eliminates the danger inherent with construction at an elevated level. The combined effect of the above-mentioned advangtages reduces the construction cost, and hence the method according to the present invention is particularly suitable for an openable dome-shaped roof structure which, in general, is costly.

We claim:

1. An openable dome-shaped roof structure comprising:

a dome-shaped stationary roof section secured at an outer periphery thereof to a side wall;

an opening formed substantially in the central portion of said stationary roof section; and a plurality of movable roof units each having a shape capable of covering one of a plurality of equal divisions of said opening and pivotably secured at one end thereof to a support located near the circumference of said opening, each of said movable roof units being turned about a respective said support between a first position where said opening is closed and a second position where said opening is opened, said movable roof units being arranged alternately on different levels along the circumferential direction so as to support each other, and said movable roof units all being driven together for simultaneous turning motion about respective said supports.

2. An openable, dome-shaped roof structure as claimed in claim 1, wherein said stationary roof section and said movable roof units are portions of concentric spherical surfaces having different radii and the axis of turning of each said movable roof unit is directed toward the center of said spherical surfaces.

3. An openable dome-shaped roof structure as claimed in claim 1, wherein each of said movable roof units is provided with a guide rail extending along a predetermined locus and rollers including a driving roller which roll along said guide rail of one of the adjacent said movable roof units.

* * * * *